US010194238B2

(12) United States Patent
Button et al.

(10) Patent No.: US 10,194,238 B2
(45) **Date of Patent: *Jan. 29, 2019**

(54) BAFFLE FOR LINE ARRAY LOUDSPEAKER

(71) Applicant: Harman International Industries, Incorporated, Stamford, CT (US)

(72) Inventors: Douglas J. Button, Simi Valley, CA (US); Richard D. Kamlet, Valencia, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/836,347

(22) Filed: Dec. 8, 2017

(65) Prior Publication Data

US 2018/0103315 A1 Apr. 12, 2018

Related U.S. Application Data

(63) Continuation of application No. 15/172,568, filed on Jun. 3, 2016, now Pat. No. 9,860,338.

(51) Int. Cl.
*H04R 1/02* (2006.01)
*H04R 1/34* (2006.01)
(Continued)

(52) U.S. Cl.
CPC ..... *H04R 1/345* (2013.01); *H04R 1/025* (2013.01); *H04R 1/26* (2013.01); *H04R 1/24* (2013.01);
(Continued)

(58) Field of Classification Search
None
See application file for complete search history.

(56) References Cited

U.S. PATENT DOCUMENTS 4,194,590 A * 3/1980 Anderson ..... G10K 11/025 181/186
4,939,703 A * 7/1990 Muller ..... G10K 11/20 181/123
(Continued)

FOREIGN PATENT DOCUMENTS

JP 2013118496 A 6/2013

OTHER PUBLICATIONS

JBL Professional by Harman, "CBT Series Brochure", 2012, 4 pgs.
International Search Report dated Aug. 18, 2017 for PCT Appn. No. PCT/US2017/032629 filed May 15, 2017, 3 pgs.

*Primary Examiner* — James Mooney
(74) *Attorney, Agent, or Firm* — Brooks Kushman, P.C.

(57) ABSTRACT

A loudspeaker baffle that provides variable sound patterns is described. The baffle may support non-low frequency sound sources and a waveguide to provide varying sound beam patterns. The baffle may include a center mount adapted to receive a plurality of audio outputs and a plurality of low frequency apertures to receive a plurality low frequency output. The waveguide may be formed from a front face of the baffle. The front face may be intermediate the center mount and the low frequency apertures. The front face may include a continuously varying waveguide surface with a first waveguide portion adjacent a first audio output of the plurality of audio outputs providing a first sound pattern and a second waveguide portion adjacent a second audio output of the plurality of audio outputs providing a second sound pattern that is different than the first sound pattern.

17 Claims, 18 Drawing Sheets

(51) Int. Cl.

| | |
|---|---|
| ***H04R 1/26*** | (2006.01) |
| *H04R 1/24* | (2006.01) |
| *H04R 1/30* | (2006.01) |
| *H04R 1/40* | (2006.01) |
| *H04R 3/12* | (2006.01) |
| *H04R 5/02* | (2006.01) |

(52) U.S. Cl.
CPC ..... *H04R 1/30* (2013.01); *H04R 1/403* (2013.01); *H04R 3/12* (2013.01); *H04R 5/02* (2013.01); *H04R 2201/401* (2013.01); *H04R 2201/403* (2013.01); *H04R 2203/12* (2013.01); *H04R 2205/022* (2013.01); *H04R 2400/11* (2013.01)

(56) References Cited

U.S. PATENT DOCUMENTS

| | | | | |
|---|---|---|---|---|
| 5,020,630 | A * | 6/1991 | Gunness ..... | G10K 11/025 181/187 |
| 2004/0047478 | A1 | 3/2004 | Combest | |
| 2006/0151237 | A1 | 7/2006 | Oxford et al. | |
| 2008/0085027 | A1 | 4/2008 | Engebretson et al. | |
| 2008/0085028 | A1 * | 4/2008 | Engebretson ..... | H04R 1/24 381/338 |
| 2009/0046875 | A1 | 2/2009 | Masuda | |
| 2016/0021481 | A1 | 1/2016 | Johnson et al. | |

* cited by examiner

BAFFLE FOR LINE ARRAY LOUDSPEAKER

CROSS-REFERENCE TO RELATED APPLICATIONS

This application is a continuation of U.S. application Ser. No. 15/172,568 filed Jun. 3, 2016, the disclosure of which is hereby incorporated in its entirety by reference herein.

TECHNICAL FIELD

The present disclosure relates to a loudspeaker baffle to provide horizontal sound coverage from a loudspeaker, more specifically, to provide continuously varying horizontal sound coverage in the vertical plane.

BACKGROUND

Loudspeakers are used to broadcast sound to an audience in a given physical space, e.g., a room or a hall. However, the sound heard by people in different locations is different do to the differences in the sound pressure level produced by the loudspeaker at different locations.

SUMMARY

A baffle that provides varying sound patterns is described. The baffle may include non-low frequency sound sources and a waveguide to provide varying sound patterns. In an example, the baffle may include a center mount adapted to receive a plurality of audio outputs and a plurality of low frequency apertures to receive a plurality low frequency output. The waveguide may be formed from a front face of the baffle. The front face may be intermediate the center mount and the low frequency apertures. The front face may include a continuously varying waveguide surface with a beginning waveguide portion adjacent a first audio output of the plurality of audio outputs providing a first sound pattern and a second waveguide portion adjacent a second audio output of the plurality of audio outputs providing a second sound pattern that is different than the first sound pattern. In an example, the front face is continuously varying.

In an example, the first waveguide portion and the second waveguide portion provide a similar sound pressure level at different distances from the baffle.

In an example, the second waveguide portion provides a wider horizontal coverage relative to the first waveguide portion.

In an example, the front face is continuously variable from the first waveguide portion to the second waveguide portion.

In an example, the center mount is coaxial with drives, e.g., compression drivers, or tweeters, e.g., direct radiating tweeters, providing the audio output and woofers providing the low frequency output. The center mount can be coaxial with compression drivers providing the plurality of audio outputs and woofers providing a low frequency output.

In an example, the low frequency apertures extend into the front face at the first waveguide portion that provides a wider horizontal sound pattern than the second waveguide portion and the low frequency apertures do not extend into the front face at the second waveguide portion.

A further embodiment may be a loudspeaker with the baffle as described herein. In an example, the loudspeaker may be a line array loudspeaker. The loudspeaker may include an elongate cabinet to house outer audio out put devices, e.g., full range drivers or woofers aligned therein and a baffle mounted to the front of the cabinet and spaced in front of the woofers. The baffle may include a center mount adapted to receive a plurality of audio outputs and a plurality of low frequency apertures to receive a plurality low frequency outputs from the woofers mounted behind the baffle. In an example, the center mount can be coaxial with compression drivers providing the plurality of audio outputs and woofers providing a low frequency output. The baffle includes a front face intermediate the center mount and the low frequency apertures, the front face including a varying waveguide surface with a first waveguide portion adjacent a first audio output of the plurality of audio outputs providing a first sound pattern and a second waveguide portion adjacent a second audio output of the plurality of audio outputs providing a second sound pattern that is different than the first sound pattern.

In an example, the baffle includes a plurality of fasteners mechanically connecting the front face to the cabinet.

In some examples, the baffle may have different side widths or differently varying surfaces on each side. By varying the shape of the sides of the baffle, the baffle can be tuned to provide the desired sound profile that varies in the horizontal planes up and down the baffle, differently on each side as well as changing in the stacked horizontal planes.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
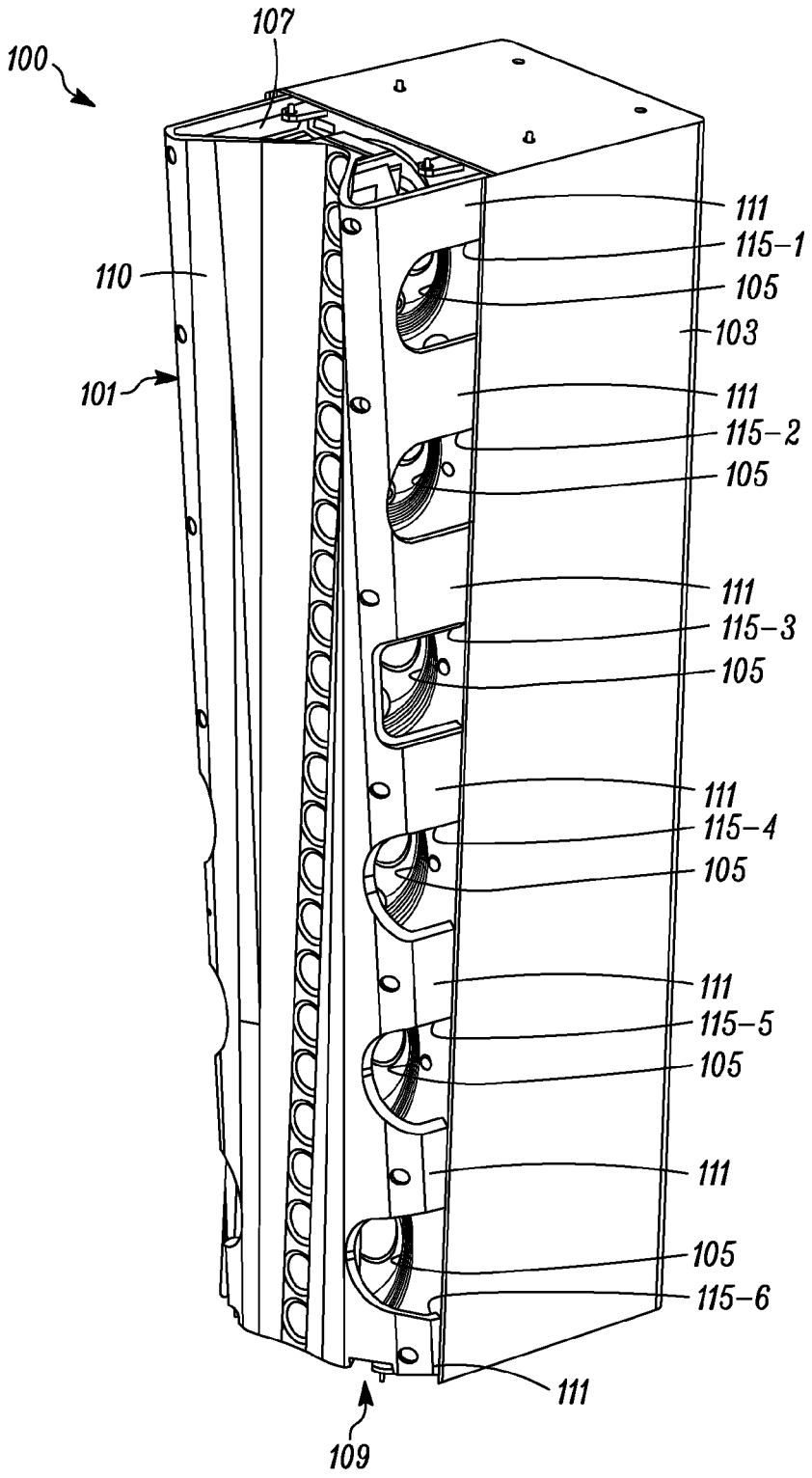
FIG. 1 is an isometric view of a loudspeaker according to an example embodiment.
Figure 2:
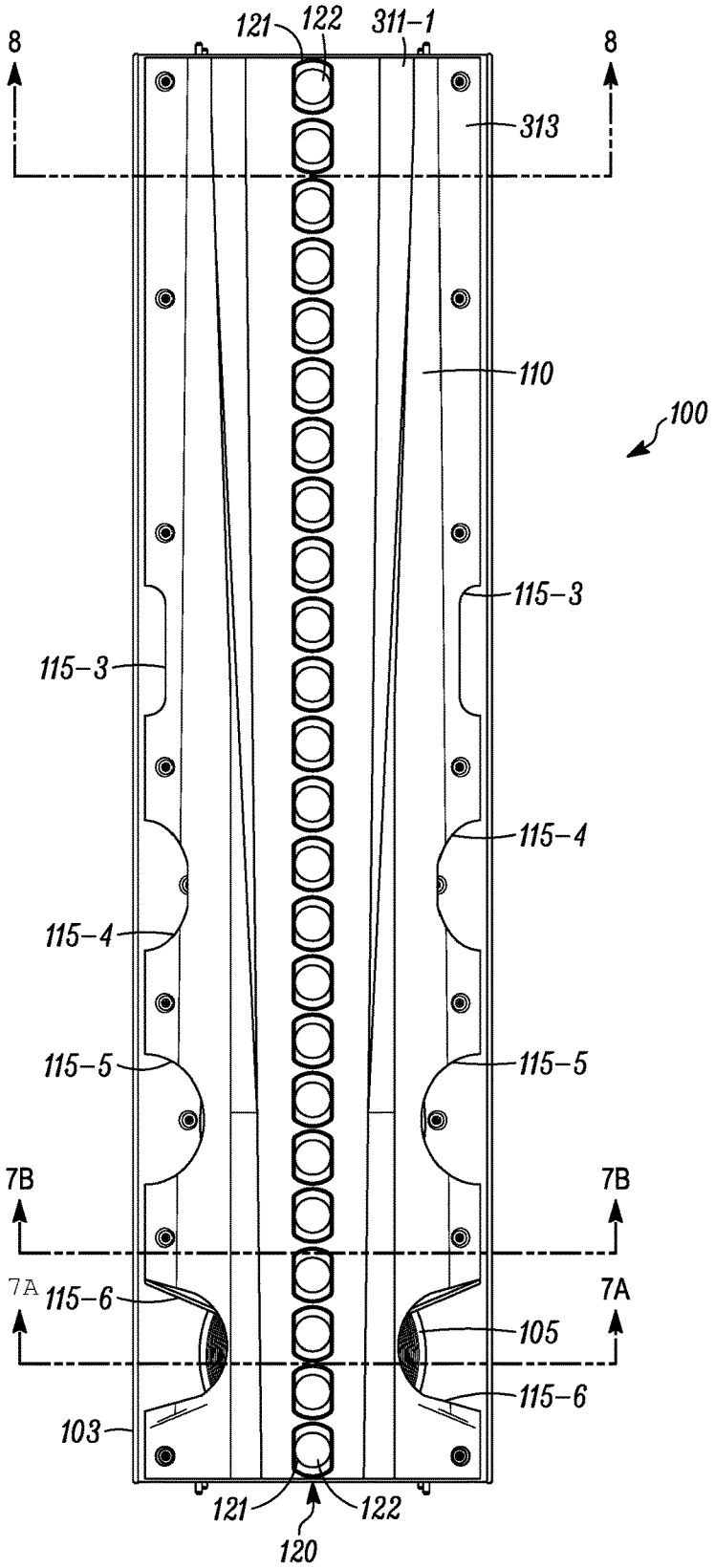
FIG. 2 is a front view of a loudspeaker according to an example embodiment.

FIGS. 1 and 2 show a front, side isometric view of a loudspeaker 100 and a front elevational view of the loudspeaker 100, respectively. The loudspeaker 100 includes a baffle 101 mounted to a cabinet 103 and extends frontward from the cabinet 103. The front of the cabinet 103 is the side where sound is emitted from the loudspeaker. The cabinet 103 includes walls defining an enclosure to house a plurality of low frequency speakers, e.g., woofers, 105 and associated electronics, e.g., speaker drivers, crossover circuitry, amplifiers and the like. As shown, the cabinet 103 has a generally regular parallelepiped shape, e.g., a cuboid. However, the cabinet may be rounded with the front wall being on the outside arc of bend in the cabinet. The low frequency speakers can be mounted in apertures in a front wall of the cabinet 103. The cabinet 103 may further include internal baffles and ports to manage the sound waves generated by the rear of the low frequency speaker 105 within the cabinet 103 and the sound waves projected from the low frequency speaker 105. The baffle 101 includes a front face 110, legs 111 and a center channel 120. The front face 110 operates as a waveguide for the sound wave produced by drivers at the baffle. The baffle front face 110 may also at least partially cover some of the low frequency speakers 105. The baffle legs 111 can space and hold the front waveguide in place in front of and spaced from the low frequency speakers 105 and front wall of the cabinet 103.

The center channel 120 is a location for audio outputs to generate sound that is guided by the front face 110. The center channel 120 may operate as a central mount to support audio outputs, e.g., drivers, to produce the sound waves that are guided by the front face. In an example, the audio outputs on the central mount of the center channel are mid-range and high frequency drivers. The audio outputs can be coaxial with the center channel 120.

The baffle 101 extends from the front wall 104 of the cabinet 103 and is in front of the low frequency speakers 105. The baffle 101 is connected to the cabinet 103. The baffle 101 may be spaced from the front of the low frequency speakers 105. The baffle 101 may define a top opening 107 between the cabinet 103 at the top thereof and the baffle. The baffle 101 may define a bottom opening 109 between the cabinet 103 at the bottom thereof and the baffle. Thus, there is an open space between the baffle front face and the cabinet throughout the entire length of the baffle. The top opening 107 may be larger than the bottom opening 109. In an example, the top opening has a larger cross section area than the bottom opening. In an example, the top opening 107 defines a top volume that is greater than a bottom volume at the bottom opening 109. To form the top opening 107 and bottom opening 109, the baffle 101 includes a face 110 spaced from the front wall of the cabinet 103. The front face 110 is shaped so that it defines a smaller space therefrom to the cabinet at the bottom opening 109 than at the top opening 107. The face 110 is not uniformly spaced from the cabinet front wall 103 and is spaced from the front wall 103 at a greater distance to form the larger opening, here shown as top opening 107.

The baffle 101 includes a plurality of legs 111 that extend rearward from the face 110. The legs 111 space the face 110 from the cabinet front wall and the low frequency speakers 105. The legs 111, in order, have a shorter height from the bottom to the top of the baffle. Accordingly, the baffle face 110 is closer to the front wall of the cabinet at the end where the legs are shortest, here the bottom end adjacent the bottom opening 109. A low frequency aperture 115 is formed between each pair of legs 111. Each aperture 115 is tuned to allow the sound energy to escape from the baffle to travel into the physical space where the loudspeaker 100 is mounted and intended to provide sound. The physical space may be a room, a theater, a church, a hall, an amphitheater or other relatively large gathering space. The apertures 115 are each the same size as measured in cross-sectional area, in an example embodiment. The low frequency aperture 115-1 at the top of the baffle is on the side of the baffle and does not extend into the baffle front face 110. The aperture 115-1 is defined by the adjacent legs 111 and a bridge portion 116 that extends between the connected ends of the cantilevered, adjacent legs 111. The bridge portion 116 is on the side of the baffle and not on the baffle front face 110. Similarly, aperture 115-2 is defined by the adjacent legs 111 and a bridge portion 117 that extends between the connected ends of the cantilevered legs 111 that are adjacent to the aperture 115-2. The bridge portion 116 is taller than the bridge portion 117. Thus the closed end of the aperture 115-1 is further from the baffle face that the closed end of the aperture 115-2. This structure can be repeated until an aperture 115 extends past the length of the adjacent pair of legs 111 and into the front face 110. The aperture extending into the front face 110 is needed so that the area of each of the apertures 115 remains substantially the same. Each successive leg 111 may be shorter than the preceding leg to allow the baffle front face 110 to be shaped to broadcast a more uniform sound pressure level to the physical space in which the loudspeaker 100 is positioned. The baffle 101 is formed to be symmetrical about its center, longitudinal axis, with the right side being a mirror image of its left side. Thus, the legs 111 on the right side mirror those on the left side of the baffle. The apertures on the right side mirror those on the left side of the baffle.

The center channel 120 supports a plurality of audio outputs. The audio outputs may be apertures or horns to provide a guide path for sound emitted from drivers mounted to the cabinet. 103. In an example, the center channel 120 defines a central mount that includes a plurality of center mounts 121 for drivers 122, which produce sound at frequencies higher than the low frequency speakers 105. The mounts 121 are arranged linearly in a single row in the channel 120. In the illustrated example, there are more drivers 122 than low frequency speakers 105. The center mount(s) 121 can be coaxial with compression drivers providing the plurality of audio outputs and woofers providing a low frequency audio output. The center channel 120 includes a planar base at which the drivers 122 are mounted. Accordingly, the drivers 122 are aligned in a vertical direction (relative to FIGS. 1 and 2) and at a same depth. The drivers 122 may be compression drivers, which are aligned to be coaxial with the center mount 121 or the center channel 120. The drivers 122 may be connected to circuitry providing a driving signal, which may be within the cabinet 103.

The baffle front face 110 is on the sides of the drivers 122 to direct the sound and control the sound pressure level at different distances and at different widths from the baffle.

The baffle front face 110 may include a first, bottom portion and a second, top portion. These portions are designed to have a smooth surface that is continuously varying. These portions are sound waveguides to control the sound patterns emitted from the baffle and loudspeaker. A transition joins the first and second portions. The transition can also be continuously varying. The transition can be uniform. The baffle front face 110 (or its first portion or second portion, individually) can be continuously curved along the longitudinal length thereof. The baffle front face 110 (or its first portion or second portion, individually) can be continuously curved along its lateral dimension thereof. For example, the surface in each of these portions does not have any discontinuities that would cause an abrupt change in the sound pattern produced by loudspeaker 100. The sound pressure level from the front face 110 can be continuously varying without any abrupt changes, e.g., no step changes. In some examples, the front face may change rapidly, e.g., a slope of greater than 1.0, or slowly, e.g., with a slope less than 1.0. The front face 110 can provide a continuously varying horizontal sound coverage from its vertical array using the continuously variable front face 110 or portions of the front face. The sound patterns emitted from the loudspeaker in the directions orthogonal to the longitudinal direction of the baffle or the loudspeaker are continuously varying due the continuously varying baffle front face 110 or portions of the front face. The gradations of the changes in the front face or the portions of the front face are continuously varying.

Figure 3:
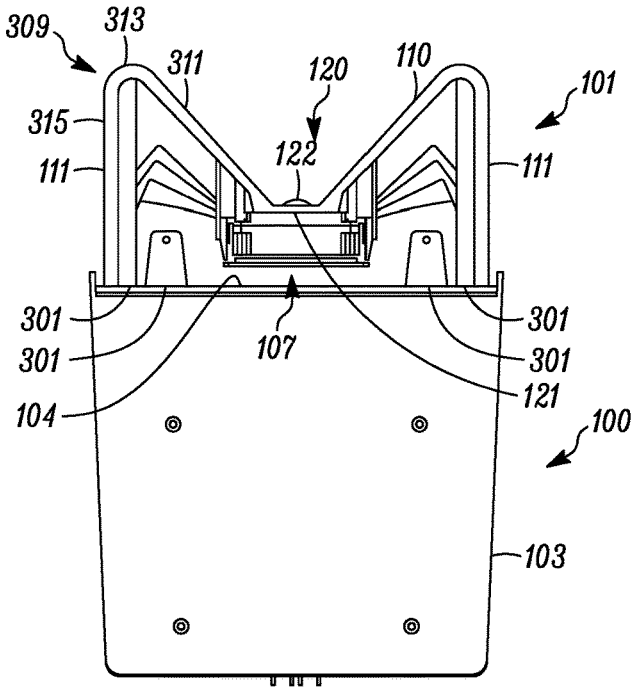
FIG. 3 is a top view of a loudspeaker according to an example embodiment.

FIG. 3 shows a top view of the loudspeaker 100 with the baffle 101 connected to the front wall 104 by fasteners 301. The fasteners 301 may include screws, bolts, rivets and the like received in female fastener portions. The fasteners 301 fix the baffle 101 to the front wall 104 of the cabinet 103. The front face 110 of the baffle 101 changes dimension from the top of the baffle (e.g., at 107) to the bottom of the baffle (e.g., at 109). In the embodiment shown, the front face 110 extends away from the cabinet at the top to a greater extent than at the bottom. At the bottom, the front face 110 is essentially flat with respect to the drivers 122 thereat. In an example, the front face at the bottom curves in a range of about 170 degrees to about 180 degrees, +/−5.0 degrees, or at 175 degrees. The front face 110 may be at the drivers 122 and curve backwardly away from the drivers 122 to the legs 111. In contrast, the front face 110 at the baffle top extends outwardly from the drivers 122 (or the bottom plate of the channel) at an angle in the range of about 30 degrees to 60 degrees. In a further example, the front face 110 at the baffle top extends outwardly from the drivers 122 (or the bottom plate of the channel) in a range of about 40 degrees to about 50 degrees, +/−5.0 degrees, or at about 45 degrees, +/−1.0 degrees. The front face 110 may be a continuous surface than blends from the outward extension at the top end of the baffle to the flat or rearward extension of the front face at the bottom end of the baffle. Thus, the front face 110 is a continuous waveguide with different waveguide characteristics from the top of the baffle to the bottom of the baffle. The above is but one example of the shape of the continuously varying front face 110 of the baffle. In an example, one end of the front face extends at an angle of about 5.0 degrees, or more. In an example, the other end of the front face 110 varies about 10.0 degrees, or more. The shape of the front face depends on the desired horizontal coverage needed to adequately, uniformly as possible, provide sound into the acoustic environment being fed by the loudspeaker. The top of the waveguide acts to direct the sound from the drivers thereat along a different pattern, e.g., with a narrower horizontal spread. The bottom of the waveguide, in this embodiment, is open and allows the sound to spread horizontally along a specific throw, e.g., shorter throw. It will be understood that the designation of the top and the bottom ends of the loudspeaker are for convenience of description. The loudspeaker could be mounted in an environment with the steeper portion of the front face (the narrower sound pattern) at the bottom and the less steep portion of the front face (the wider sound pattern) at the top.

Figure 4:
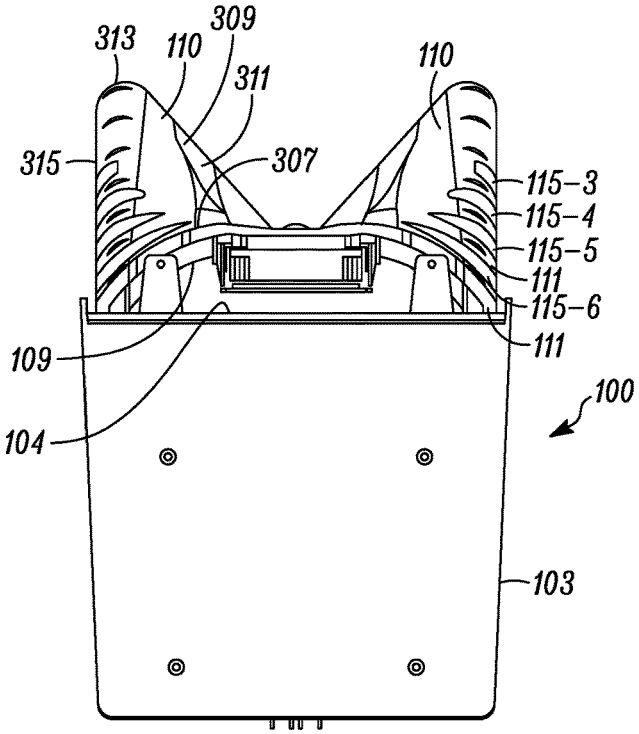
FIG. 4 is a bottom view of a loudspeaker according to an example embodiment.

FIG. 4 shows a bottom view of the loudspeaker 100 with the baffle 101 connected thereto. The front face 110 is shown with a view of bottom opening 109. The front face 110 has a bottom end 307 that is essentially flat at the drivers 122. The bottom end 307 rounds downwardly toward the front wall of the cabinet 103. The top end 309 of the front face 110 is defined by a wall portion 311 that is flat and extends outwardly from the drivers 122 to act as the sides of the waveguide. The wall portion 311 blends into an outer wall portion 315 through a curve 313. The outer wall 315 extends from the curve 313, which is the outward most extent of the front face 110, back toward the cabinet. The outer wall 315 at least partially defines the legs 111. The apertures 115 to the low frequency speakers 105 are only positioned in the outer wall portion 315 at the top end where the front face is acting as a waveguide. The apertures 115 extend into the curve 313 in the middle and bottom end of the front face 110. The apertures 115 extend into the wall portion 311 at the bottom end of the baffle front face 110.

Figure 5:
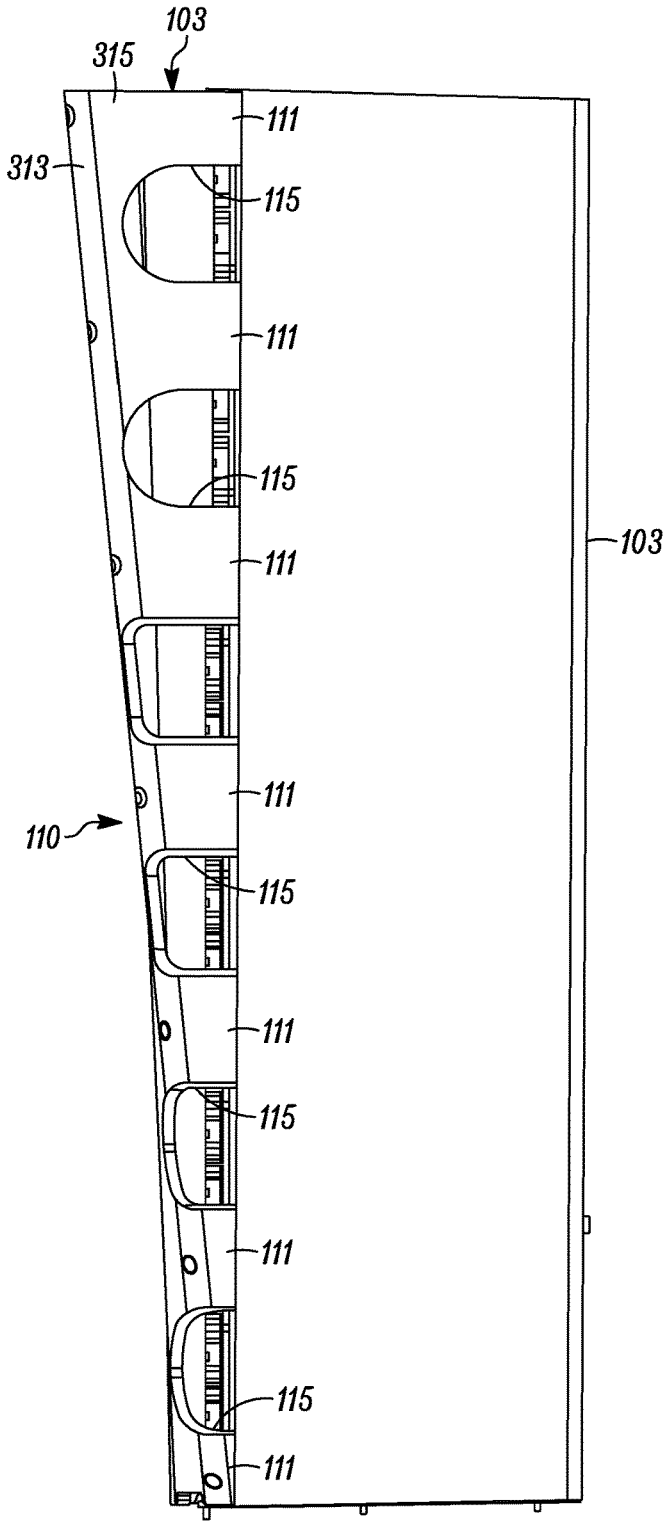
FIG. 5 is a side view of a loudspeaker according to an example embodiment.

FIG. 5 shows a side view of the loudspeaker 100 with the baffle 101 and the cabinet 103. The rise of the baffle front face 110 in height outwardly from the cabinet 103 is clearly shown from the bottom to the top of the baffle. The top of the baffle restricts the sound pattern (e.g., waves) from expanding in the horizontal direction and may extend the throw in the transmission direction. This directs more sound pressure to the rear of the physical space in which the loudspeaker is placed.

Figure 6:
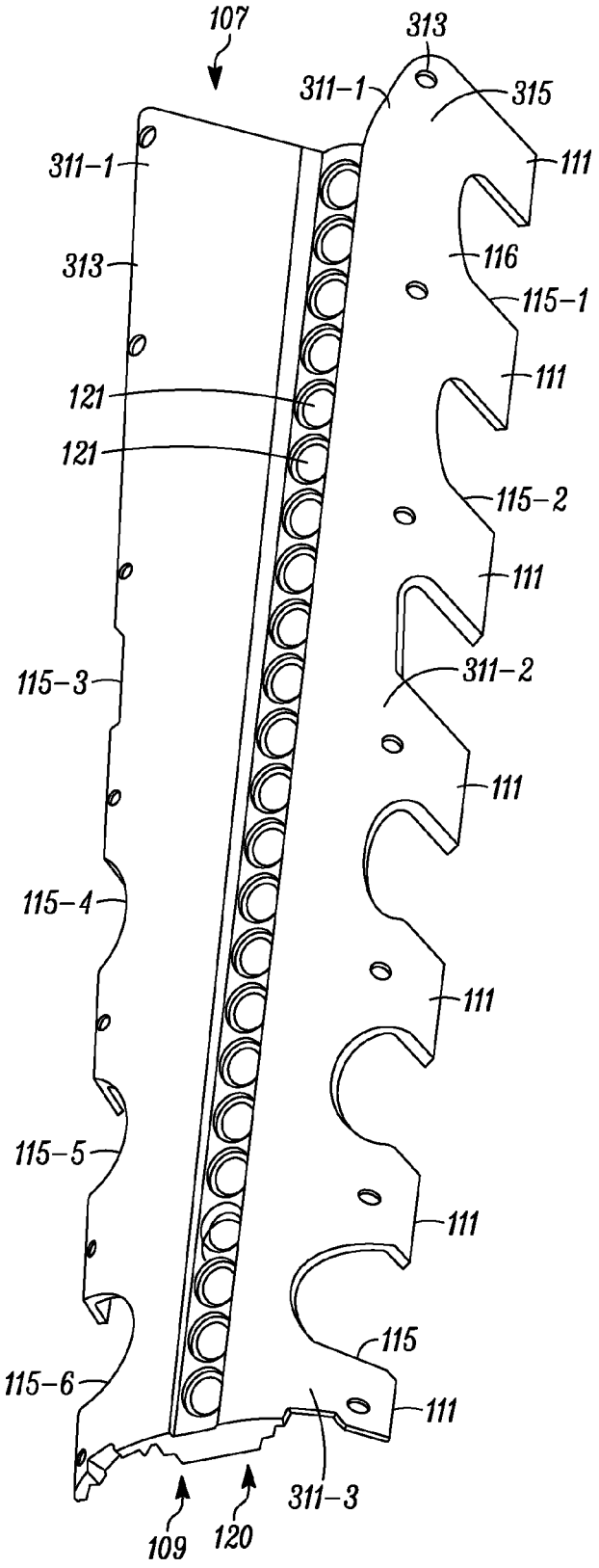
FIG. 6 is front perspective view of a loudspeaker according to an example embodiment.

FIG. 6 shows a front, side perspective view of the baffle 101. The baffle 101 includes the front face 110, which has a different waveguide shape at the top portion 311-1 than in the middle portion 311-2 and the bottom portion 311-3. The top portion 311-1 has a smooth surface that guides the middle and high end frequencies, relative to an audible hearing range, on a narrower (and maybe longer throw) sound pattern than the middle portion 311-2 and the bottom portion 311-3. The front face of the top portion 311-1 is continuous and variable in shape with the steepest height at one end of the top portion 311-1. The middle portion 311-2 has a smooth surface that guides the middle and high end frequencies, relative to the audible hearing range, on a medium width sound (and maybe an intermediate throw) sound pattern relative to the top portion 311-1 and the bottom portion 311-3. The front face of the middle portion 311-2 is continuous and variable in shape. The bottom portion 311-3 has a smooth surface that guides the middle and high end frequencies, relative to the audible hearing range, on a wide (and maybe short throw) sound pattern relative to the top portion 311-1 and the middle portion 311-2. The front face of the bottom portion 311-3 is continuous and variable in shape. In an example, the transition between the top portion 311-1 and the middle portion 311-2 may be discontinuous, e.g., a step or a radical difference in the curvature of the middle portion relative to the top portion. In an example, the transition between the bottom portion 311-3 and the middle portion 311-2 may be discontinuous, e.g., a step or a radical difference in the curvature of the bottom portion 311-3 relative to the middle portion 311-2. The transitions between the portions may be continuously varying to change the sound pattern in a horizontally continuous manner. The transitions may be uniform with the adjoining portions when the portion begins. The baffle 101 may be mounted to a loudspeaker or a loudspeaker array. However, within each portion 311-1, 311-2 and 311-3, the front face thereat is continuously varying to continuous control the sound pattern from the plurality of sound sources.

Figure 7A:
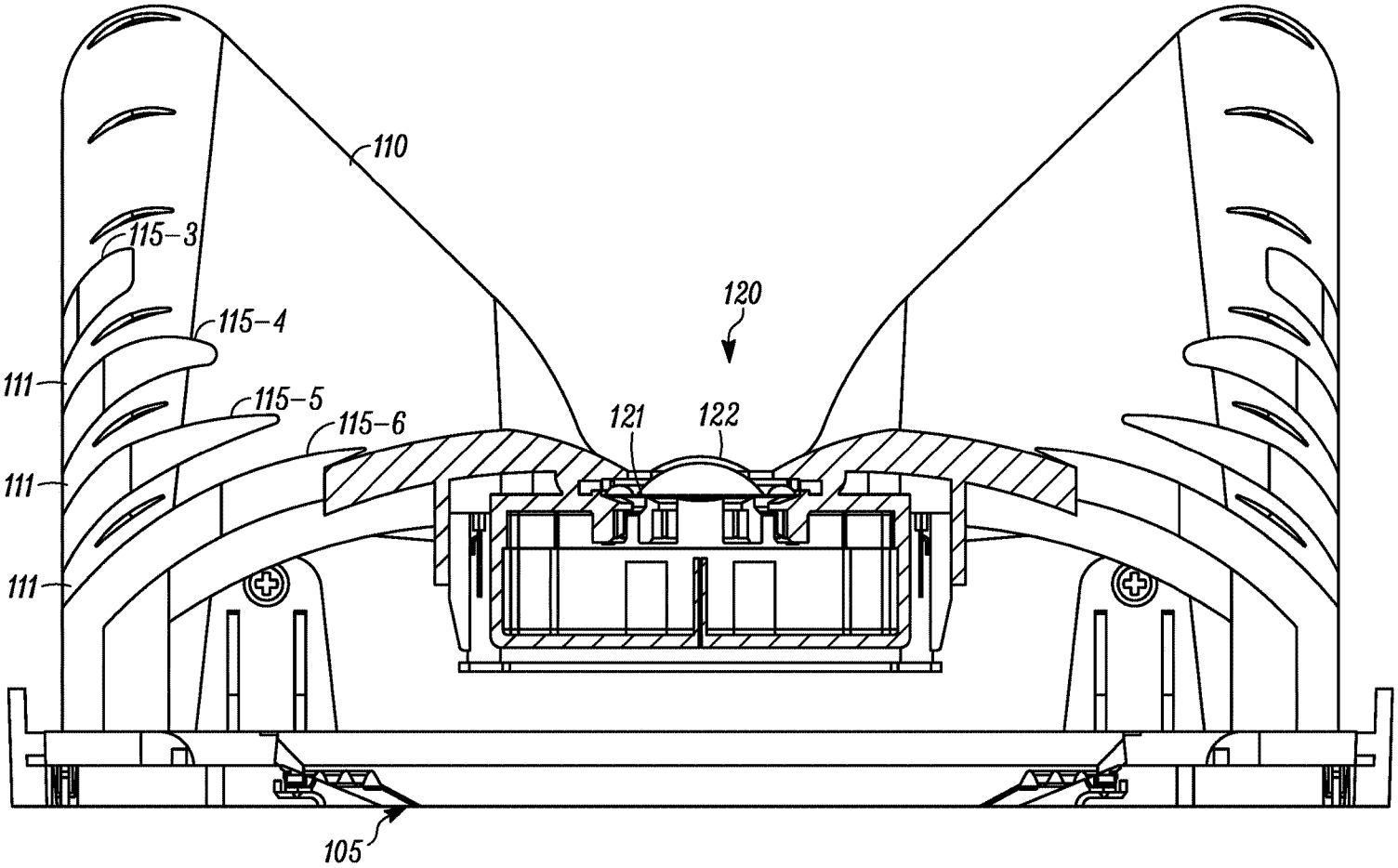
FIG. 7A is a cross sectional view, partial taken generally along line 7A-7A in FIG. 2.

FIG. 7A shows a cross sectional, partial view along line 7A-7A of FIG. 2. The cross section only shows the front of the cabinet 103, with low frequency drivers or woofers, and the baffle 101. The front face 110 gradually curves from the cut plane to the top of the loudspeaker 100. The front face 110 is continuous to provide a varying horizontal sound pattern from a wider throw to a narrower, longer sound pattern at the top. The top of the front face 110 at its peak is about 2.5 times taller than the front face at the cut line near the bottom tenth of the loudspeaker. It will be understood that the loudspeaker could be mounted flipped with horizontal throw pattern from a narrower, longer sound pattern to a horizontally wider sound pattern at the top.

Figure 7B:
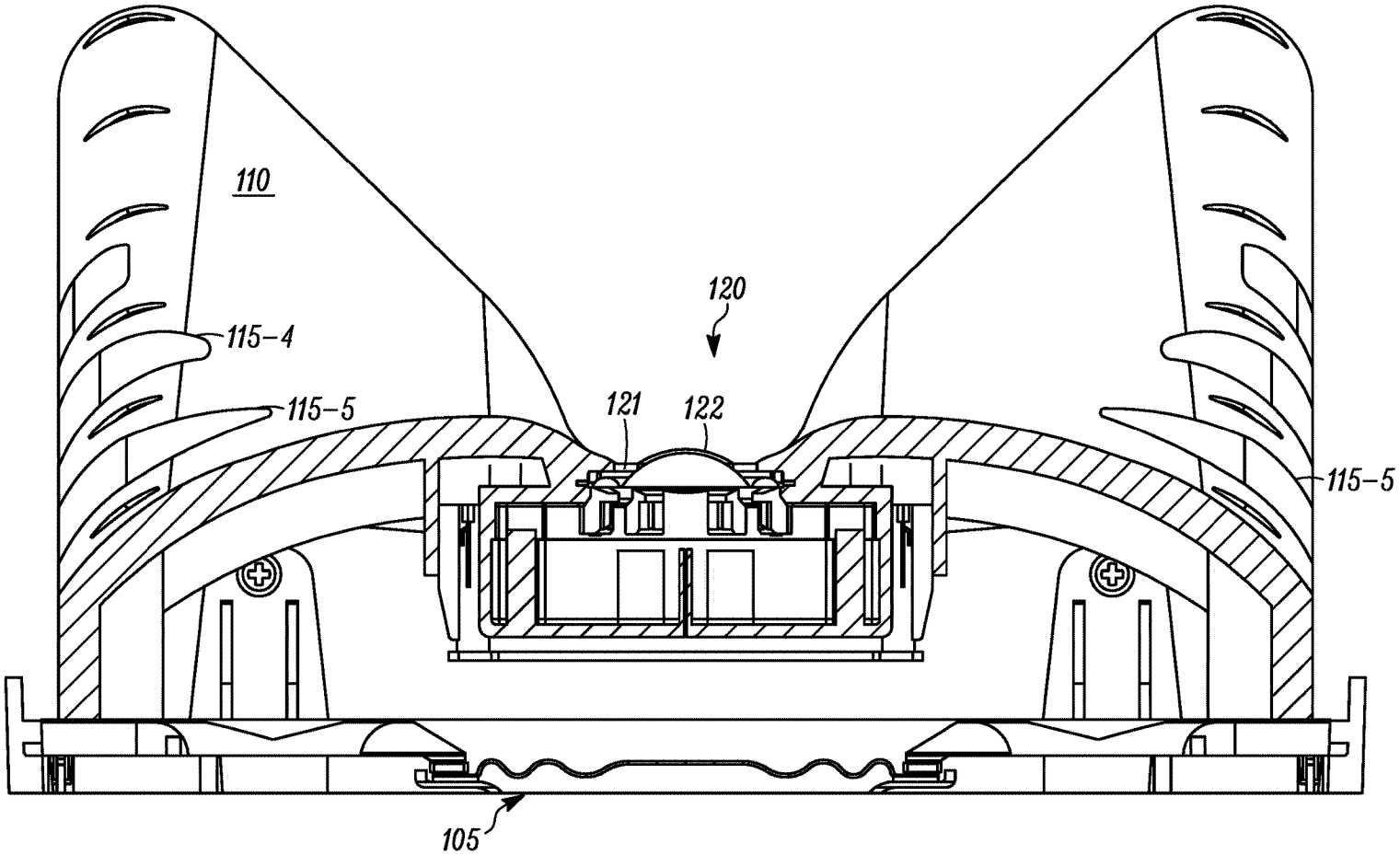
FIG. 7B is a cross sectional, partial view taken generally along line 7B-7B in FIG. 2.

FIG. 7B shows a cross sectional, partial view along line 7B-7A of FIG. 2, which is similar to FIG. 7A but taken higher on the loudspeaker 100. The front face 110 gradually curves from the cut plane to the top of the loudspeaker 100. The front face 110 is continuous to provide a varying horizontal sound pattern from a wider sound pattern to a narrower, longer sound pattern at the top. In a specific and non-limiting example, the top of the front face 110 at its peak is about 2.25 times taller than the front face at the cut line near the tenth of the loudspeaker. It will be appreciated that the longitudinal length of the loudspeaker is not limited to the illustrated examples and may continue such that the cross section is at a different location along the loudspeaker.

Figure 8:
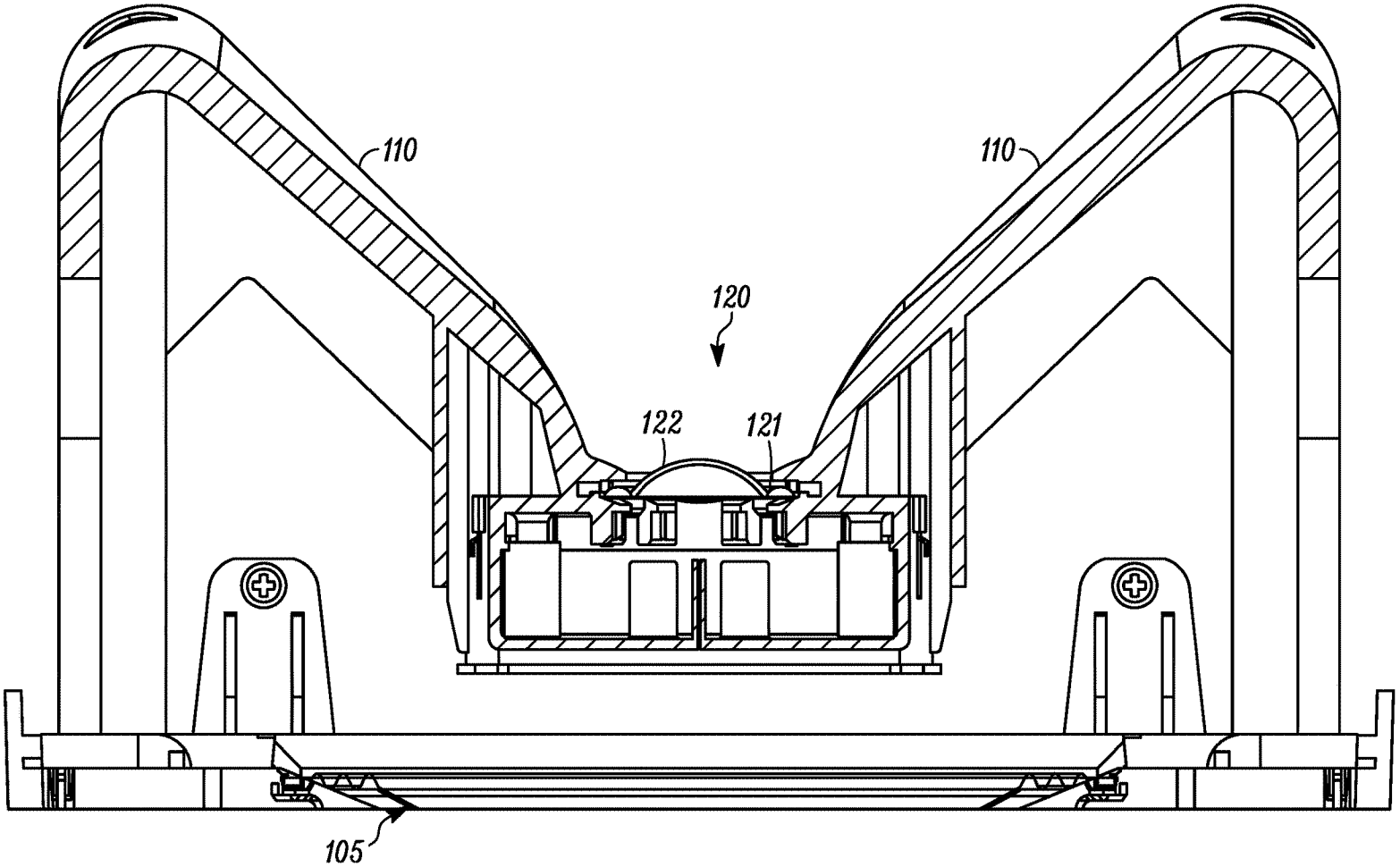
FIG. 8 is a cross sectional view, partial taken generally along line 8-8 in FIG. 2.

FIG. 8 shows a cross sectional, partial view along line 8-8 of FIG. 2. This cross sectional view is taken near the top tenth of the loudspeaker 100. Again, the front face 110 is continuously curved to provide a horizontal sound pattern that changes with the front face and is continuously changing. It will be appreciated that the longitudinal length of the loudspeaker is not limited to the illustrated examples and may continue such that the cross section shown in FIG. 8 is at a different location along the loudspeaker.

Figure 9:
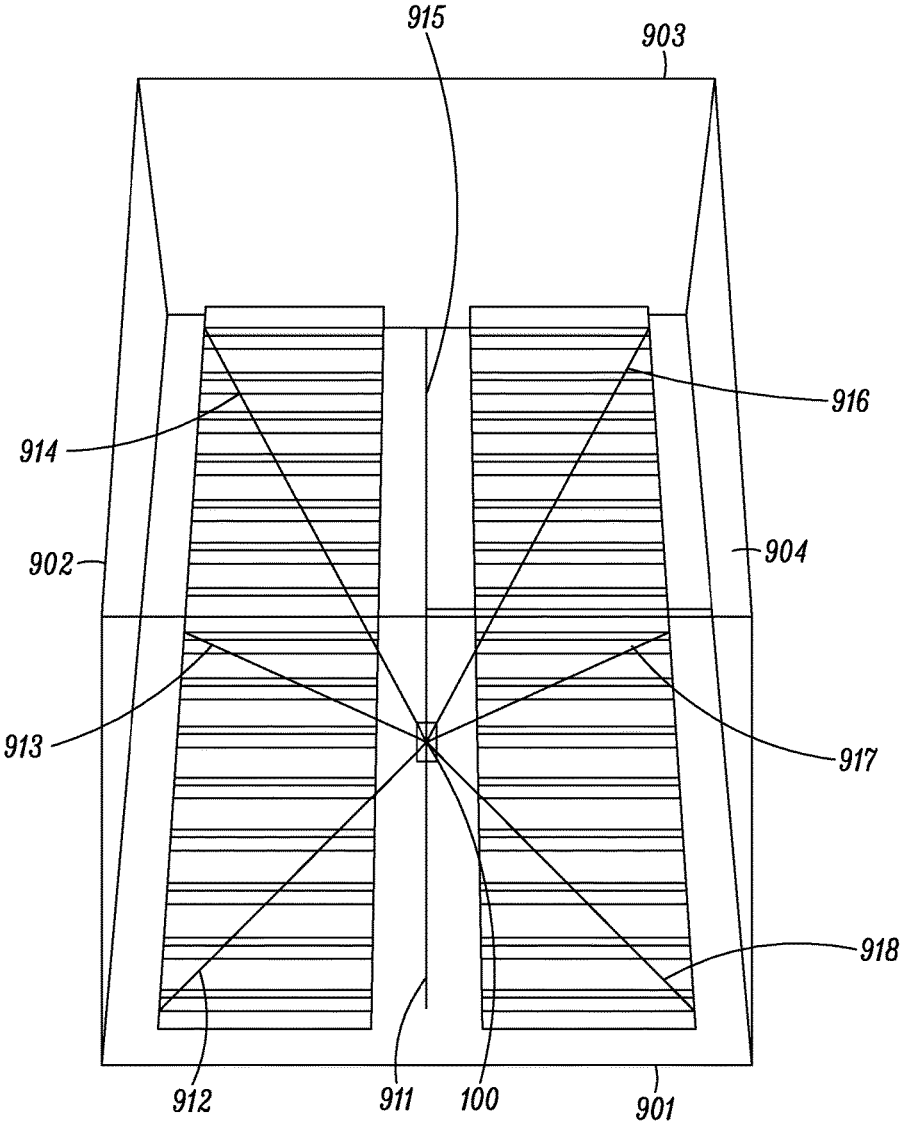
FIG. 9 is schematic view of the loudspeaker in a room according to an example embodiment.

FIG. 9 shows a bird's eye schematic view of a room 800 with the loudspeaker 100 positioned at a front of the room 800. The loudspeaker 100 is represented as a point source for ease of illustrating the performance of the loudspeaker. The room 800 includes walls, e.g., a front wall 801, a left side wall 802, a rear wall 803 and a right side wall 804. It will be recognized that the present loudspeaker is adaptable to rooms of different shapes and different numbers of walls. It is desirable to equalize the sound pressure level throughout the room so that the sound experienced throughout the room is as uniform as possible. To achieve this balance the sound pressure along each of the travel paths, e.g., the travel paths designated as 911-918, is as uniform as possible. The baffle 101 as described herein assists in shaping the sound waves to achieve the uniform sound pressure level across the various frequencies and with continuously varying sound patterns. The one end of the baffle 101 (as shown the top) guides the sound produced by the drivers adjacent the one end to the rear of the room (far end wall 901). For example, the top of the baffle will direct sound waves toward the 914-916 travel paths. The middle of the baffle 101 will direct sound waves toward the middle of the room, e.g., from path 916 past path 917. The other end of the baffle 101 will direct sound waves toward the near end (near wall 901) of the room, e.g., from path 916 past path 917. The baffle 101 operates to direct sound waves along the narrow width and longer travel path to reach the far end wall 903 of the room while directing sound waves with a wider width and shorter travel path at the front of the room, adjacent the front wall 901.

Figure 10:
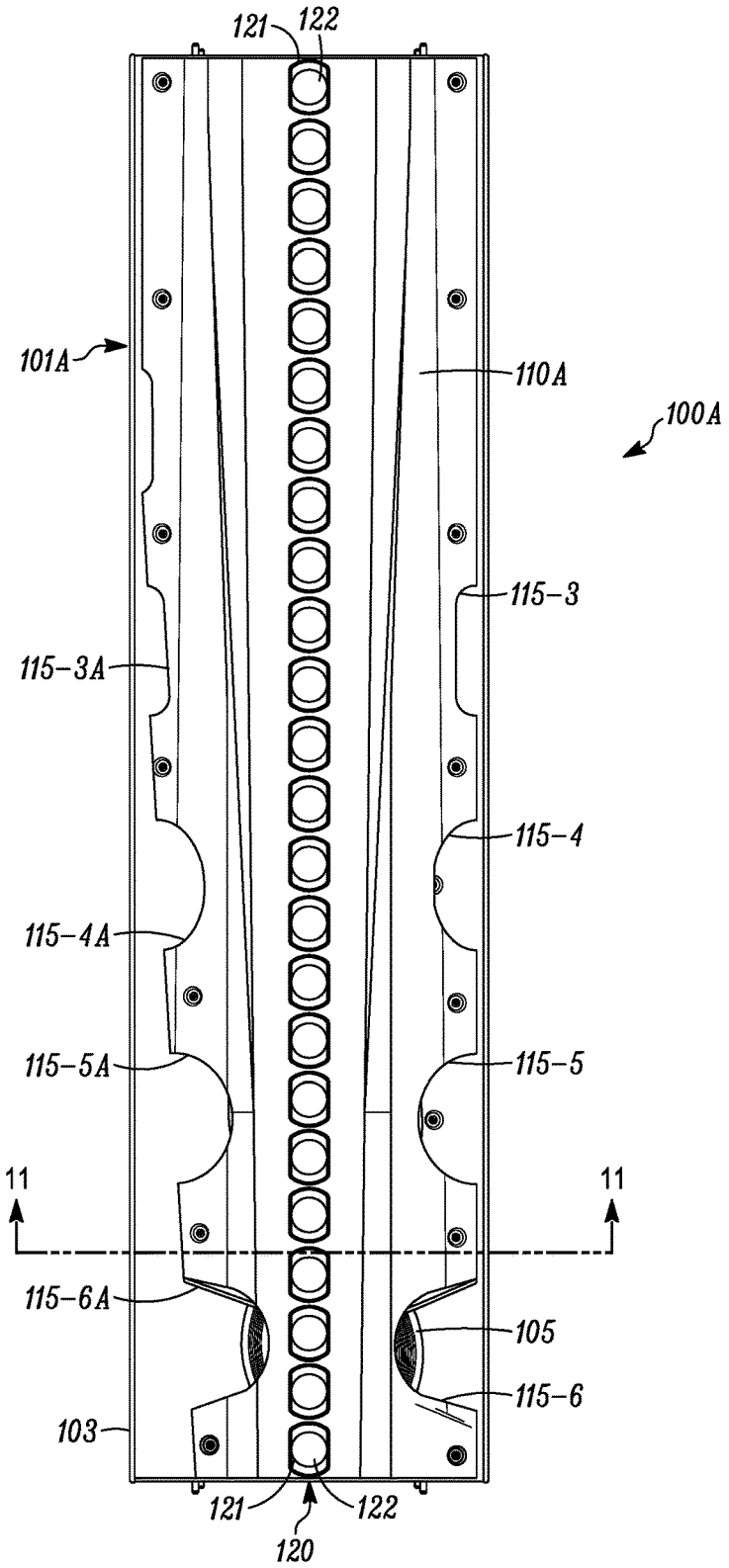
FIG. 10 is a front view of a loudspeaker according to an example embodiment.

FIG. 10 shows a loudspeaker 100A with another embodiment of a baffle 101A that is asymmetrical. The left side of the baffle 101A has a shorter width than the right side of the baffle 101A as measured from the center mount 121. The width of the entire baffle is smaller at the bottom and progressively grows wider up the baffle 101A. In an example, the top portion of the baffle 101A is the same as the top portion of the baffle 101 described above. The asymmetry is not limited to the width of the baffle 101A on each side. The asymmetry may also reflect differences on top and bottom relative to each side as well as the rate of change can be different for each side. Baffle 101A may produce a sound pattern in the horizontal planes that is different on the two sides of the loudspeaker 100A. The sound pattern can be continuously varying on each side while being a different pattern, e.g., asymmetrical about the center longitudinal plane of the loudspeaker 100A.

FIGS. 11A-14C shows schematic views of the baffle for a loudspeaker. The baffle 101B-101E can have different widths and different slopes, either from top to bottom or outwardly. The baffle 101B-101E can also be asymmetrical about its center longitudinal plane of line, e.g., with one side of the baffle having a different continuously varying shape relative to the other side. Thus, the sound patterns may be different on each side of the loudspeaker while being continuously variable.

Figure 11A:
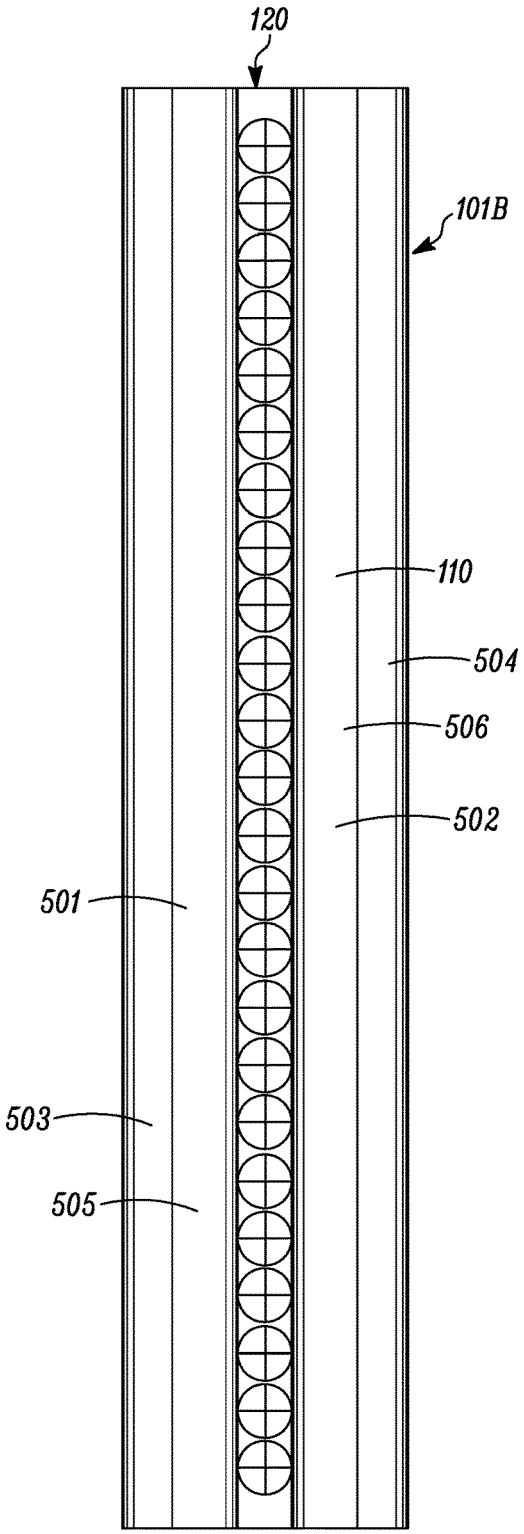
FIG. 11A is a front view of a loudspeaker according to an example embodiment.

FIG. 11A shows a front schematic view of a baffle 101B according to an example. The front face 110 of the baffle 101B has two sides 501, 502 outwardly of the center channel 120, which can act as a center mount for the audio outputs on the baffle 101B. The sides 501, 502 have a substantial surface portion or the entirety of the surfaces forming a continuous variable surface to control the horizontal sound pattern from that part of the baffle. The sides 501, 502 are asymmetrical about the center channel 120 or the longitudinal center line. The first side 501 and the second side 502 have the same width, but increase in depth at a different rate from each other. This shape difference will produce different sound patterns on the different sides of the loudspeaker.

Figure 11B:
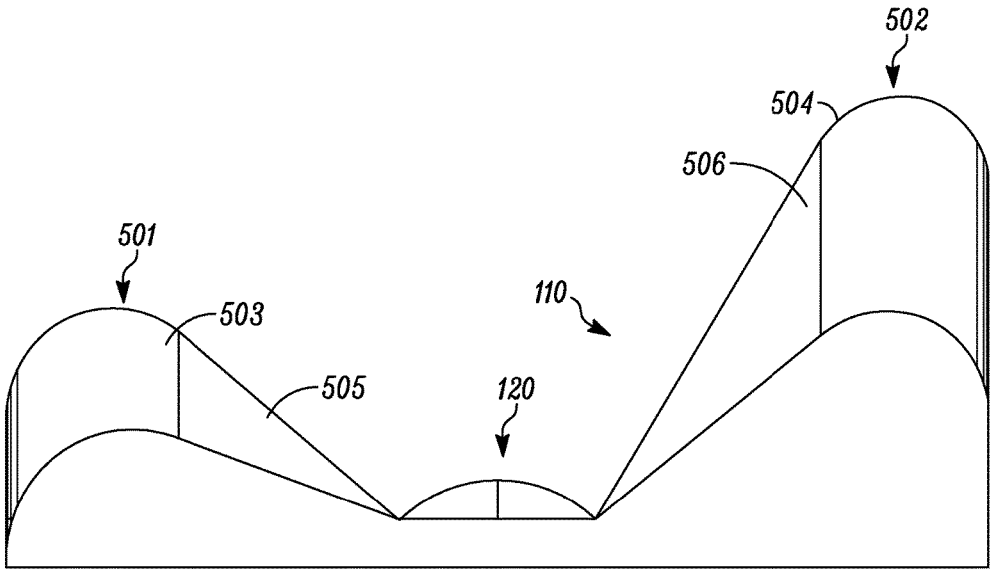
FIG. 11B is a bottom view of the FIG. 11A loudspeaker.

FIG. 11B shows a bottom schematic view of the baffle 101B. The first (right) side 501 starts at a first depth and continuously slopes upwardly to the top of the baffle 101B. The curved surface 503 at the highest point of the side is formed by an arc that has in increasing radius from the bottom to the top of the side 501. The inner portion 505 of the first surface 501 can be planar in an example. The inner portion 505 can also be curved from the bottom to the top with an increasing radius of an arc defining the inner portion. The surface 502 includes a curved portion 504 outwardly of the inner portion 506. The curved portion 504 has a first curvature with a first radius that is greater than the bottom radius of the bottom of the curved surface 503. The curved portion 504 can be a constant radius from the bottom to the top of the surface 502. The surface 502 increases in height (depth in FIG. 1) from the bottom to the top. The inner portion 506 can be planar in an example. The inner portion can be curved in an example.

Figure 11C:
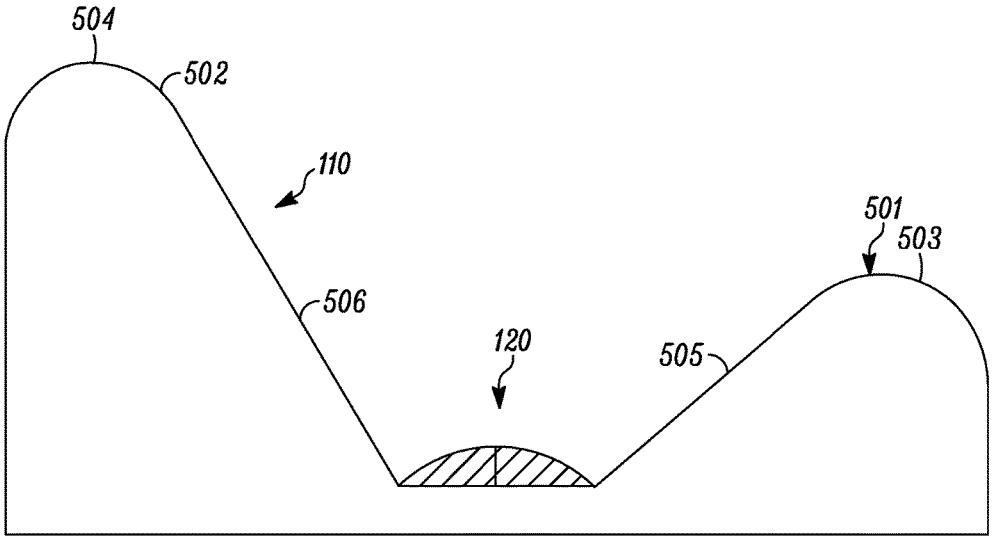
FIG. 11C is a top view of the FIG. 11A loudspeaker.

FIG. 11C shows the top schematic view of the baffle 101B. The first side 501 shows that the top is the greatest dimensions relative to the dimensions toward the bottom of the baffle. The second side 502 shows that the top is the greatest dimensions relative to the dimensions toward the bottom of the baffle.

Figure 12A:
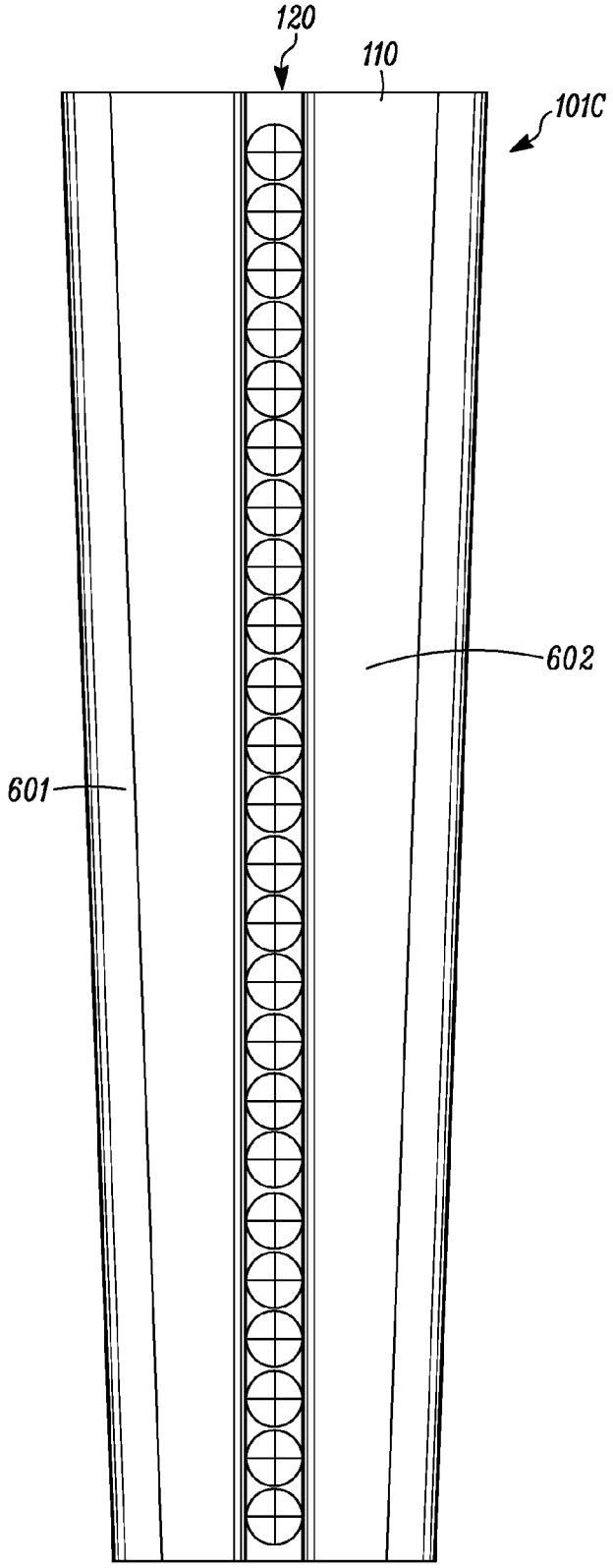
FIG. 12A is a front view of a loudspeaker according to an example embodiment.

FIG. 12A shows a front schematic view of a baffle 101C for a loudspeaker according to an example. The front face 110 of the baffle 101C has two sides 601, 602 outwardly of the center channel 120. The center channel 120 can act as a center mount for the audio outputs on the baffle 101C. The lateral dimension of the side 601 is different than the lateral dimension of the side 602. The side 601 increases in the lateral dimension from the bottom to the top. The side 602 also increases in the lateral dimension from the bottom to the top. The first side 601 and the second side 602 will both produce respective sound patterns that are each continuously variable for the horizontal planes. However, these sound patterns may not be the same or mirror images of each other.

Figure 12B:
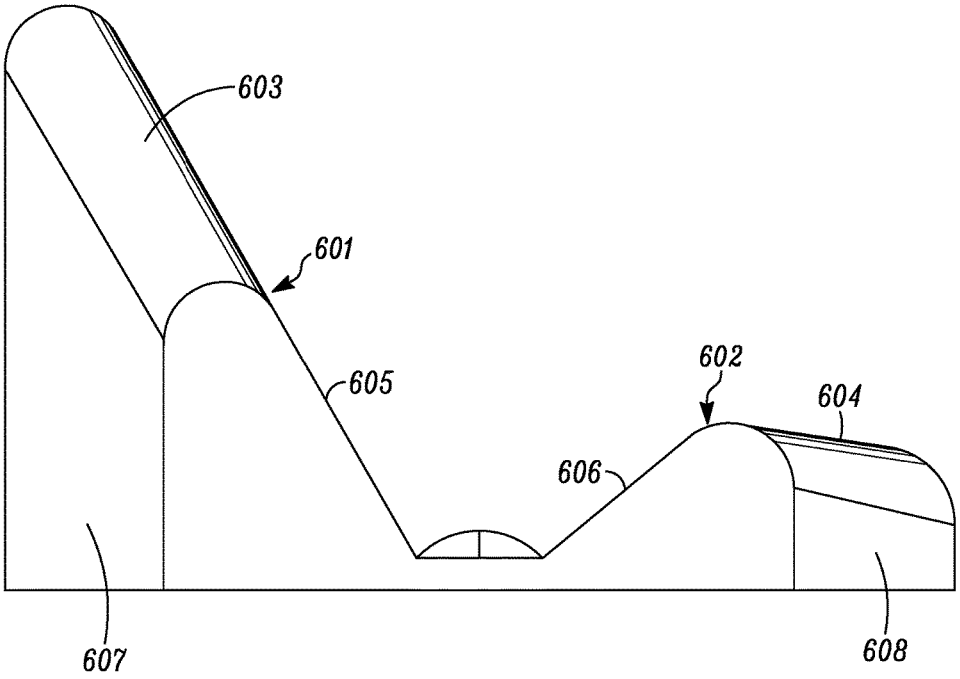
FIG. 12B is a bottom view of the FIG. 12A loudspeaker.

FIG. 12B shows a bottom schematic view of the baffle 101C. The right side 601 includes a curved portion 603 at the peak with an inner portion 605 sloping down from the curved portion 603 to the center channel 120. An outer portion 607 extends downwardly from the curved portion 603. The inner portion 605 can be planar. In an example, the inner portion 605 can curve slightly. The curved portion 603 can be defined by a radius that is constant from the bottom of the baffle to the top of the baffle. The curved portion 603 can extend outwardly along its longitudinal length. The outer portion 607 can be planar. The left side 602 includes a curved portion 604 at the peak with an inner portion 606 sloping down from the curved portion 604 to the center channel 120. An outer portion 608 extends downwardly from the curved portion 604. The inner portion 606 can be planar. In an example, the inner portion 606 can curve slightly. The curved portion 604 can be defined by a radius that is constant from the bottom of the baffle to the top of the baffle. The curved portion 604 can extend outwardly along its longitudinal length. The outer portion 608 can be planar. The curved portion 604 at the bottom of the baffle can have the same height as at the top of the baffle. The peak of the curved portion 604 has a height less than the height of the curved portion 603 at any position along the longitudinal direction of the baffle 101C.

Figure 12C:
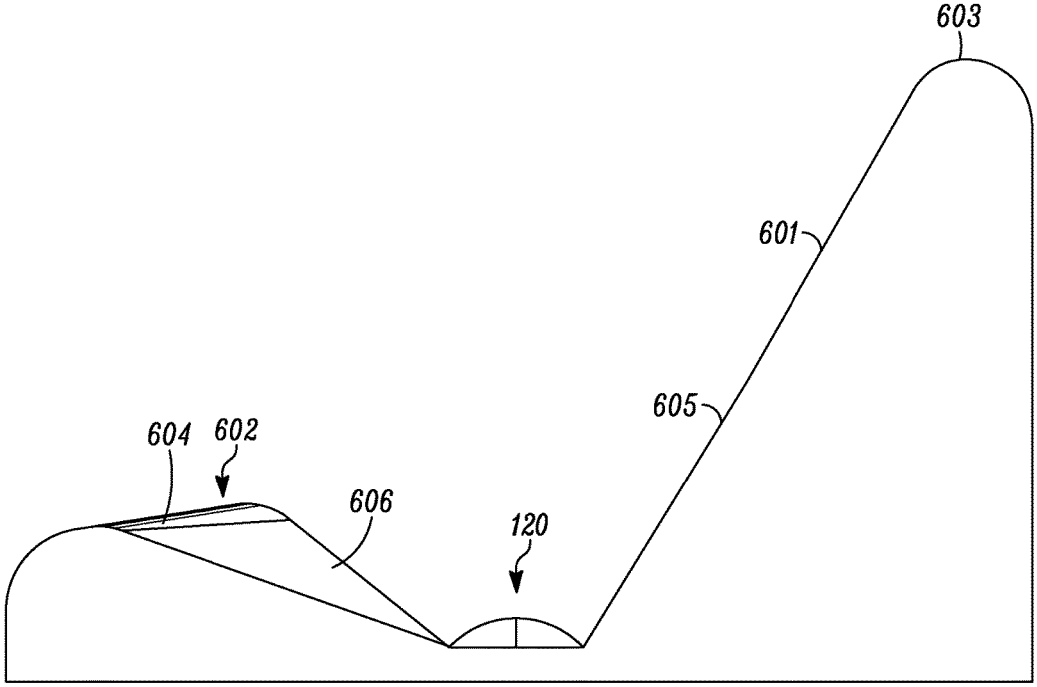
FIG. 12C is a top view of the FIG. 12A loudspeaker.

FIG. 12C shows the top schematic view of the baffle 101C. The first side 601 shows that the top is the greatest dimensions relative to the dimensions toward the bottom of the baffle 101C. The second side 602 shows that the top is the same dimensions relative to the dimensions toward the bottom of the baffle with the top being positioned laterally outwardly relative to the bottom.

Figure 13A:
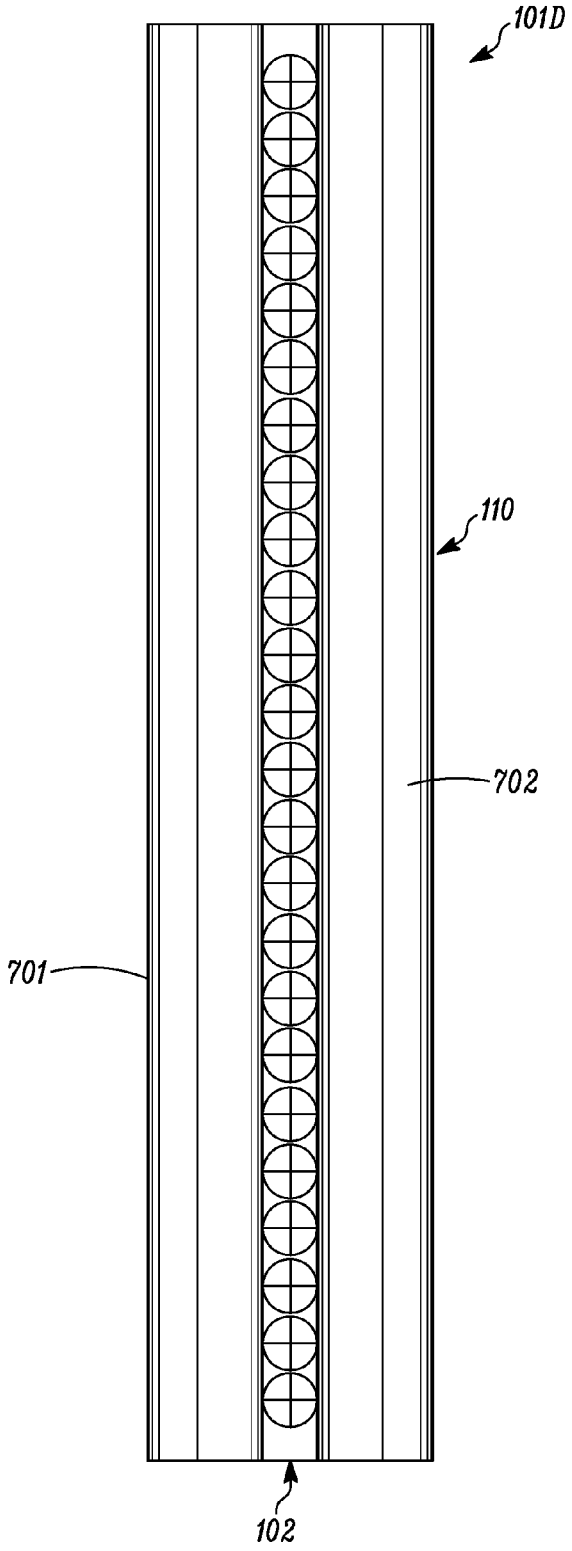
FIG. 13A is a front view of a loudspeaker according to an example embodiment.

FIG. 13A shows a front view of a loudspeaker with a baffle 101D according to an example. The front face 110 of the baffle 101D has two sides 701, 702 outwardly of the center channel 120. The center channel 120 can act as a center mount for the audio outputs on the baffle 101D. The sides 701, 702 have a substantial surface portion or the entirety of the surfaces forming a continuous variable surface to control the horizontal sound pattern from that part of the baffle. The sides 701, 702 are asymmetrical about the center channel 120 or the longitudinal center line. The first side 701 and the second side 702 have the same width from the longitudinal center, but increase in depth at a different rate from each other. The first side 701 and the second side 702 will both produce respective sound patterns that are each continuously variable for the horizontal planes. However, these sound patterns may not be the same or mirror images of each other.

Figure 13B:
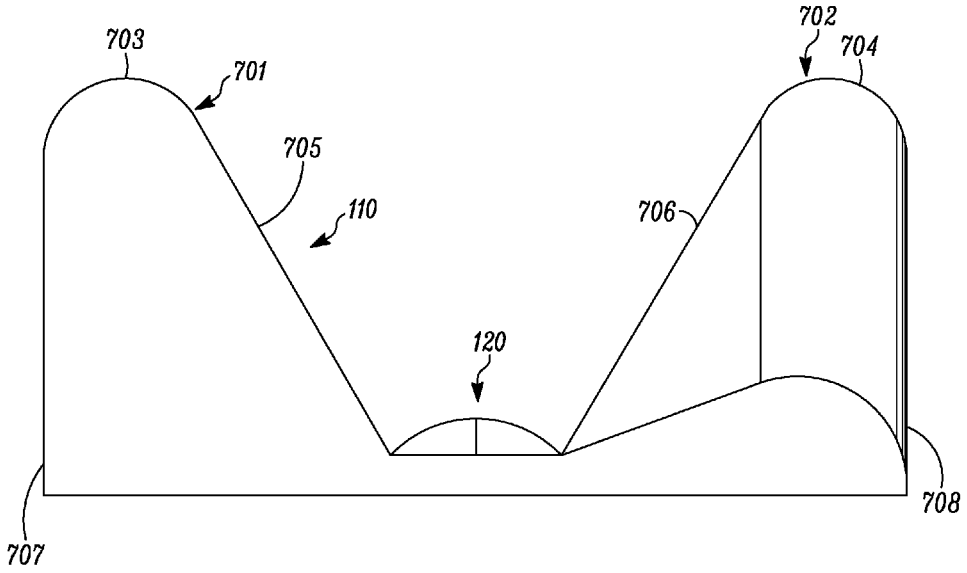
FIG. 13B is a bottom view of the FIG. 13A loudspeaker.

FIG. 13B shows a bottom schematic view of the baffle 101D. The first (right) side 701 includes a curved portion 703 defining a peak of the first side 701 and an inner surface 705 extending from the curved portion 703 to the center channel 120. The curved portion 703 has a same radius from the bottom to the top of the baffle 101D and its peak is parallel to the center channel 120 or the longitudinal center line of the baffle 101D. An outer surface 707 of the first side 701 is essentially planar. The right side 701 has a greatest height near the bottom and slopes downwardly to the top. The second (left) side 702 includes a curved portion 704 defining a peak of the second side 702 and an inner surface 706 extending from the curved portion 704 to the center channel 120. The curved portion 704 has a same radius from the bottom to the top of the baffle 101D and its peak is parallel to the center channel 120 or the longitudinal center line of the baffle 101D. An outer surface 708 of the second side 702 is essentially planar. The left side 702 has a least height near the bottom and slopes upward to the top.

Figure 13C:
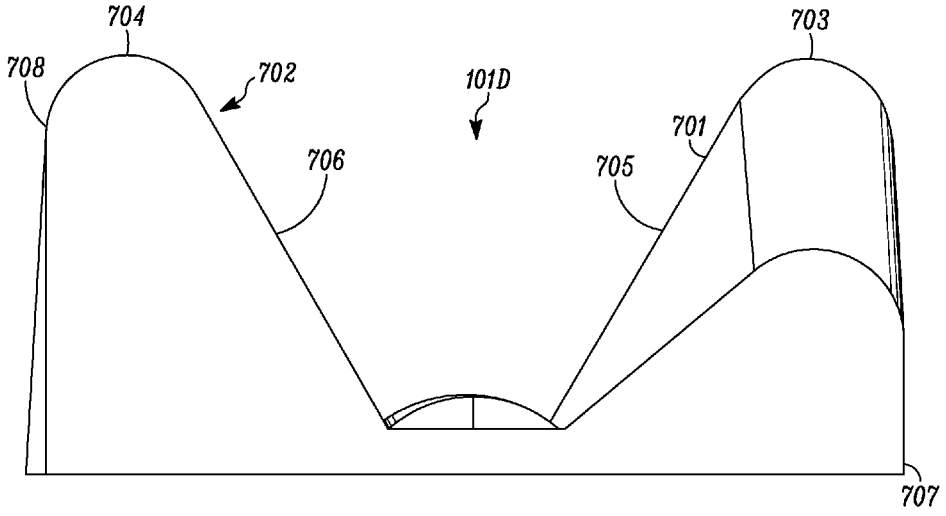
FIG. 13C is a top view of the FIG. 13A loudspeaker.

FIG. 13C shows a top schematic view of the baffle 101D. The first (right in FIG. 13C) side 701 slopes downwardly from the bottom to the top of the baffle. The second (left in FIG. 13C) side 702 slopes downwardly from the top to the bottom of the baffle.

Figure 14A:
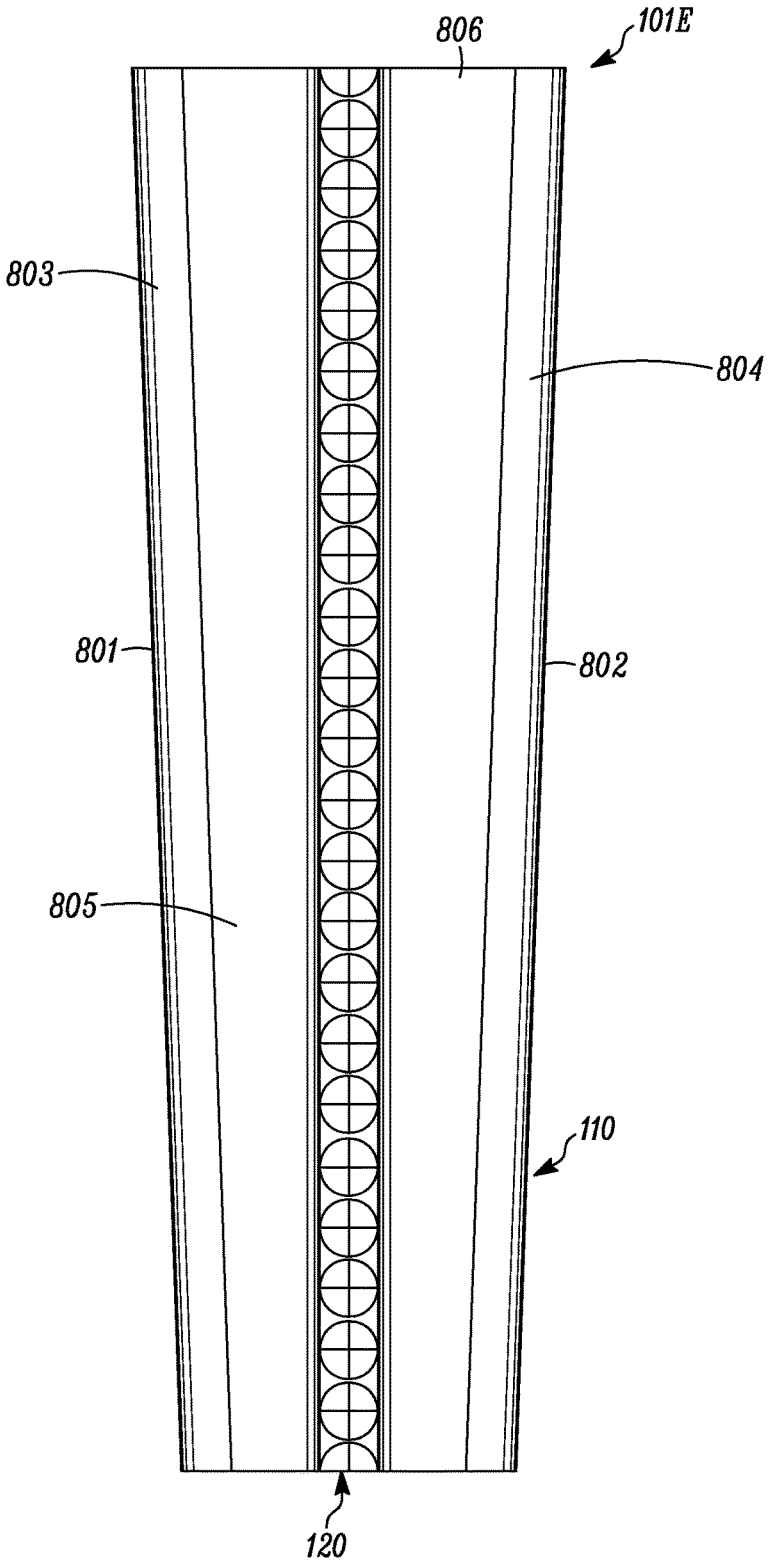
FIG. 14A is a front view of a loudspeaker according to an example embodiment.

FIG. 14A shows a front view of a loudspeaker with a baffle 101E according to an example. The front face 110 of the baffle 101E has two sides 801, 802 outwardly of the center channel 120. The center channel 120 can act as a center mount for the audio outputs on the baffle 101E. The right side 801 has an increasing width from the bottom to the top of the baffle 101E. The left side 802 has an increasing width from the bottom to the top of the baffle 101E. The first side 801 and the second side 802 will both produce respective sound patterns that are each continuously variable for the horizontal planes. However, these sound patterns may not be the same or mirror images of each other.

Figure 14B:
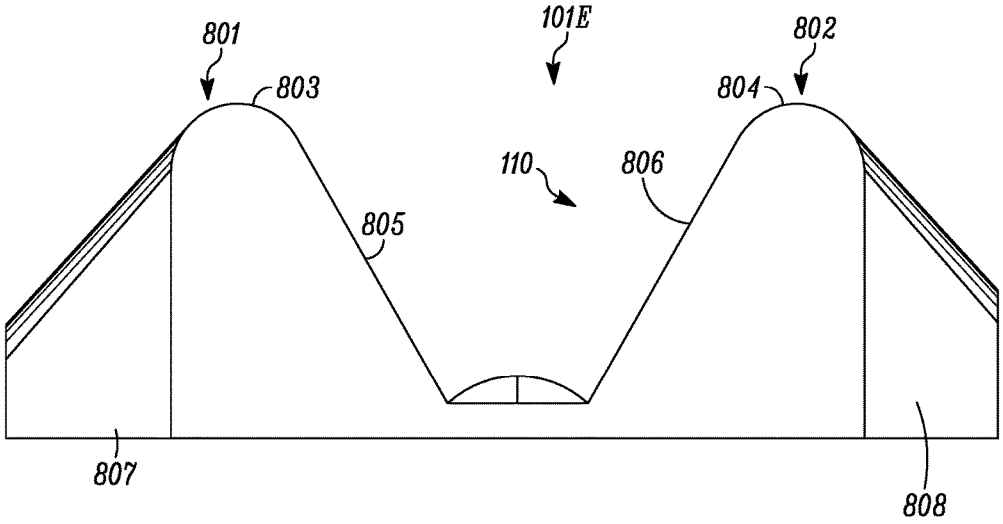
FIG. 14B is a bottom view of the FIG. 14A loudspeaker.

FIG. 14B shows a bottom schematic view of the baffle 101E. The first (right) side 801 includes a curved portion 803 defining a peak of the first side 801 and an inner surface 805 extending from the curved portion 803 to the center channel 120. The curved portion 803 has a same radius from the bottom to the top of the baffle 101D and its peak is non-parallel to the center channel 120 or the longitudinal center line of the baffle 101D. An outer surface 807 of the first side 801 is essentially planar. The second (left) side 802 includes a curved portion 804 defining a peak of the second side 802 and an inner surface 806 extending from the curved portion 804 to the center channel 120. The curved portion 804 has a same radius from the bottom to the top of the baffle 101D and its peak is non-parallel to the center channel 120 or the longitudinal center line of the baffle 101D. An outer surface 808 of the second side 802 is essentially planar.

Figure 14C:
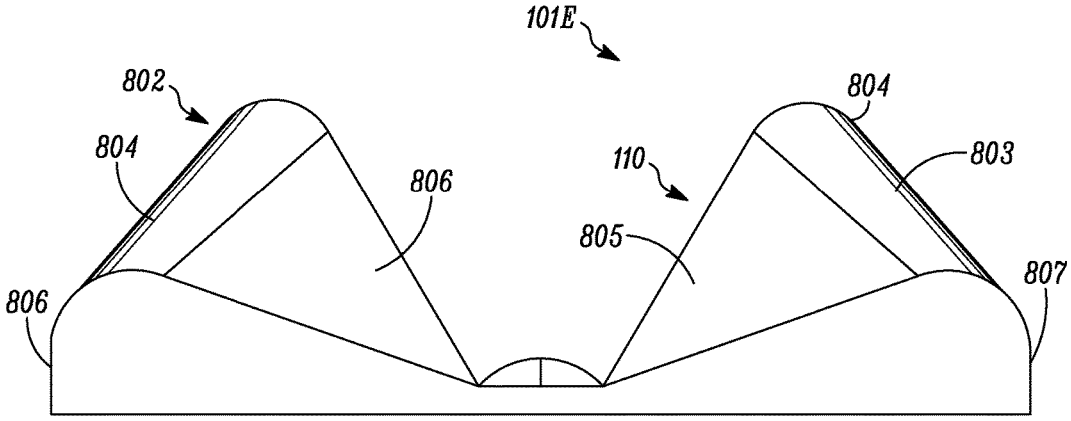
FIG. 14C is a top view of the FIG. 14A loudspeaker.

FIG. 14C shows a top schematic view of the baffle 101E. The first (right in FIG. 14C) side 801 slopes upwardly and inwardly from the top to the bottom of the baffle 101E. The second (right in FIG. 14C) side 802 slopes upwardly and inwardly from the top to the bottom of the baffle 101E.

It will be appreciated that any of the schematic views of the baffle may have the structure of the other baffles described herein. The baffle may include the apertures for loud frequency sound. The baffle may include different wall widths and heights.

The baffle 101 can act as a waveguide for the sound emitters of the loudspeaker 100. The baffle 101 can control the sound patterns, e.g., the shape of the sound in the non-longitudinal direction. The baffle 101 can have individual portions that behave differently as waveguides. The portions are individually continuously variable to control the width and shape of the sound pattern in the non-longitudinal directions (control the horizontal direction as shown in the figures).

The front face 110 of the baffle 101 is described as being a continuous surface that varies it outward projection, e.g., height or depth, along the length of the baffle and the loudspeaker. This outward projection grows progressively taller and steeper upwardly along the longitudinal direction of the loudspeaker 100. This allows some sound from the driver array to be guided toward a longer throw, e.g., narrower spread (a first sound pattern), and some sound from the driver array to be guided with a shorter throw, e.g., a wider spread (a second sound pattern). The top portion of the baffle provides the longer throw and a narrower sound pattern in the illustrated examples. The bottom portion of the baffle provides the shorter, wider sound pattern in the illustrated examples. In an example, the front face 110 does not guide the sound from the driver array with the shorter throw at all.

It is within the scope of the present disclosure to provide a unitary front face that is not smoothly continuous but has steps therein to provide different sound patterns, (e.g., throws or widths) at different locations along the baffle front face 110. These different locations can be separated by steps in the front face of the baffle.

It will be understood that at least a portion of the baffle has a continuously variable surface to control the sound pattern of the baffle. Some portions of the baffle may be flat or unchanging. Some portions of the baffle may change at a greater rate than other portions. In an example, the top portion of the baffle is continuously variable and the bottom portion is uniform in its shape. The continuously variable portion of the baffle is not entirely uniform in its shape. In other examples, the middle portion is uniform in its shape and the top portion and bottom portion are both continuously variable. In an example, the bottom portion is continuously variable. In a further example, one side of the baffle is uniform and the other side in continuously variable.

The present description uses various directional terms, e.g., front, rear, top and bottom and works of similar import, to describe various embodiments. These terms are used relative to the drawings. The loudspeaker 100 may be mounted in other positions, e.g., upside down or rotated 90 degrees, to achieve the desired acoustic performance in a given physical space. The present disclosure is not limited to a specific orientation of the loudspeaker relative to the physical space in which it is broadcasting sound unless specifically claimed. With this in mind, the present description uses the term horizontal and words of similar import to describe the sound pattern being controlled by the baffles. The horizontal control of the sound pattern may be orthogonal to the longitudinal axis of the elongate loudspeaker or loudspeaker array that includes the presently described baffle. Thus, in some embodiments, horizontal is not in reference to the environment of the loudspeaker, but is with reference to the vertical, i.e., the longitudinal, direction of the loudspeaker.

The presently described baffle provides a waveguide to shape the response of the loudspeaker to provide uniform horizontal sound coverage in the areas that are controlled by a uniformly changing portion of the baffle. These waveguides/horns may be attached to compression drivers. The present inventors have recognized the need for a waveguide in a baffle for a loudspeaker direct radiating drivers in a line array allow multiple throw paths to control the sound pressure level throughout the physical space that the line array loudspeaker is broadcasting. The present disclosure has a continuously variable horizontal coverage baffle from top to bottom. The top portion is a narrow waveguide which will produce a louder signal for a "longer throw." As the pattern widens going down the waveguide the sound pressure level (SPL) will drop providing a more constant SPL in the shorter throw and a wider pattern. The present disclosure may be valuable when the line array speaker has been set up with delays to provide a down firing pattern into the physical space. The widening waveguide directs the sound from the loudspeaker to keep the down firing (lower portion of the array) SPL lower while keeping the pattern narrow and louder for the beam shooting straight ahead (the long throw). The loudspeaker is designed to provide a continuous horizontal pattern in the human hearing range.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A baffle comprising:

a plurality of audio outputs; and a front face adjacent the plurality of audio outputs, the front face including a first wall and a second wall forming a waveguide surface, wherein the first wall has a first continuously varying height, and wherein the second wall has a second continuously varying height that is different than the first continuously varying height.

2. The baffle of claim 1, wherein the waveguide surface produces a sound wave that is horizontally wider from the first wall than the second wall.

3. The baffle of claim 1, wherein the first wall is spaced from the second wall at a continuously varying lateral distance.

4. The baffle of claim 1, wherein the first wall includes a first portion and the second wall includes a second portion that is spaced from the first portion at a continuously varying lateral distance.

5. The baffle of claim 1, wherein the front face has a first width at a first end and a second width at a second end with the first width being greater than the second width.

6. The baffle of claim 1, wherein the front face is elongate with a first end and a second end, wherein the first wall at the first end is shorter than the second wall, and wherein the first wall at the second end is taller than the second wall.

7. A baffle comprising:

a plurality of audio outputs;

a front face adjacent the plurality of audio outputs, the front face including a first wall and a second wall forming a waveguide surface, the first wall having a first peak, the second wall having a continuously variable height and a second peak, the first peak exceeding the height of the second peak.

8. The baffle of claim 7, wherein the first wall is continuously variable in height.

9. The baffle of claim 7, wherein the first wall has a first portion that has a continuously varying height.

10. The baffle of claim 7, wherein the first wall and the second wall are a waveguide acoustically coupled directly to a plurality of linearly aligned electro-acoustical drivers at the plurality of audio outputs with the plurality of audio outputs being in a same plane.

11. The baffle of claim 7, wherein the first wall varies continuously along its length, and wherein the second wall varies continuously along its length at a different rate than the first wall.

12. A baffle comprising:

a plurality of audio outputs; and a front face adjacent the plurality of audio outputs, the front face including a varying waveguide surface with a first waveguide portion adjacent a first audio output of the plurality of audio outputs providing a first sound beam pattern and a second waveguide portion adjacent a second audio output of the plurality of audio outputs providing a second sound beam pattern that is different than the first sound beam pattern, wherein the first waveguide portion includes a longitudinal axis and a lateral axis with the first waveguide portion being asymmetrical relative to the second waveguide portion.

13. The baffle of claim 12, wherein the first waveguide portion varies continuously along its length, and wherein the second waveguide portion varies continuously along its length at a different rate than the first waveguide portion.

14. The baffle of claim 12, wherein the first waveguide portion include a first wall and the second waveguide portion includes a second wall, wherein the first wall varies continuously along its length, and wherein the second wall varies continuously along its length at a different rate than the first wall.

15. The baffle of claim 12, wherein the plurality of audio outputs defines the centerline of the baffle, wherein the plurality of audio outputs receive a plurality of same plane, linearly aligned electro-acoustical drivers, and wherein the first waveguide portion is asymmetrical about the centerline relative to the second waveguide portion.

16. The baffle of claim 12, wherein the second waveguide portion extends outwardly relative to the first waveguide portion in both a lateral direction and a depth direction.

17. The baffle of claim 12, wherein the front face is elongate with a first end and a second end, wherein the first waveguide portion at the first end is shorter than the second waveguide portion, and wherein the first waveguide portion at the second end is taller than the second waveguide portion.

* * * * *